US011691423B2

(12) United States Patent
Chen et al.

(10) Patent No.: US 11,691,423 B2
(45) Date of Patent: Jul. 4, 2023

(54) UNIFORM PRINT HEAD SURFACE COATING

(71) Applicant: Hewlett-Packard Development Company, L.P., Spring, TX (US)

(72) Inventors: Chien-Hua Chen, Corvallis, OR (US); Michael G. Groh, Corvallis, OR (US); Bo Song, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/417,875

(22) PCT Filed: Jul. 30, 2019

(86) PCT No.: PCT/US2019/044178
§ 371 (c)(1),
(2) Date: Jun. 24, 2021

(87) PCT Pub. No.: WO2021/021136
PCT Pub. Date: Feb. 4, 2021

(65) Prior Publication Data

US 2022/0143978 A1 May 12, 2022

(51) Int. Cl.
*B41J 2/16* (2006.01)
*B41J 2/14* (2006.01)

(52) U.S. Cl.
CPC ..... *B41J 2/1606* (2013.01); *B41J 2/1433* (2013.01); *B41J 2002/14475* (2013.01)

(58) Field of Classification Search
CPC ..... B41J 2/1606; B41J 2/1433
See application file for complete search history.

(56) References Cited

U.S. PATENT DOCUMENTS

| | | | | |
|---|---|---|---|---|
| 5,148,193 | A | 9/1992 | Inamoto et al. | |
| 5,212,496 | A | 5/1993 | Badesha et al. | |
| 5,230,926 | A | 7/1993 | Narang et al. | |
| 5,502,470 | A * | 3/1996 | Miyashita | B41J 2/1632 347/45 |
| 5,759,421 | A | 6/1998 | Takemoto et al. | |
| 5,902,704 | A | 5/1999 | Schoenborn et al. | |

(Continued)

FOREIGN PATENT DOCUMENTS

| | | | |
|---|---|---|---|
| CN | 1942317 | A | 4/2007 |
| CN | 1970300 | A | 5/2007 |

(Continued)

*Primary Examiner* — Jason S Uhlenhake
(74) *Attorney, Agent, or Firm* — Foley & Lardner LLP

(57) ABSTRACT

Aspects of the present disclosure are directed to forming a layer of material on a print head. As may be implemented in a manner consistent with examples herein, a layer of material from a transfer film is pressed against a surface of a print head, in which the surface defines fluid nozzle openings that extend from the surface into the print head. Portions of the material pressed onto the surface are therein adhered to the surface and caused to wrap over edges of the surface extending around the openings. The transfer film is removed along with a thickness of the material pressed into contact with the surface that remains adhered to the transfer film, as well as some or all of other regions of the material over the openings. The remaining layer of the material on the surface is thus formed with a uniform thickness.

13 Claims, 4 Drawing Sheets

(56) References Cited

U.S. PATENT DOCUMENTS

| | | | |
|---|---|---|---|
| 6,042,219 | A | 3/2000 | Higashino et al. |
| 6,151,045 | A | 11/2000 | Beach et al. |
| 6,179,978 | B1 | 1/2001 | Hirsch et al. |
| 6,312,103 | B1 | 11/2001 | Haluzak |
| 6,737,109 | B2 | 5/2004 | Stanton et al. |
| 7,594,718 | B2 | 9/2009 | Soutar et al. |
| 8,042,908 | B2 | 10/2011 | Clark et al. |
| 8,632,162 | B2 | 1/2014 | Vaeth et al. |
| 8,690,288 | B2 | 4/2014 | Gumina |
| 8,851,630 | B2 | 10/2014 | Sambhy et al. |
| 8,991,954 | B2 | 3/2015 | Govyadinov et al. |
| 9,044,943 | B2 | 6/2015 | Chang et al. |
| 9,073,323 | B2 | 7/2015 | Sambhy et al. |
| 9,221,247 | B2 | 12/2015 | Cruz-Uribe et al. |
| 9,855,566 | B1 | 1/2018 | Craft et al. |
| 10,015,887 | B2 | 7/2018 | Zenou et al. |
| 2001/0044030 | A1 | 11/2001 | Veerasamy et al. |
| 2002/0000169 | A1 | 1/2002 | Suda et al. |
| 2003/0020785 | A1 | 1/2003 | Andrews |
| 2003/0210299 | A1 | 11/2003 | Min et al. |
| 2004/0231780 | A1 | 11/2004 | Clark et al. |
| 2004/0246291 | A1 | 12/2004 | Kinpara |
| 2005/0012781 | A1 | 1/2005 | Miura et al. |
| 2005/0068367 | A1 | 3/2005 | Kato et al. |
| 2005/0243129 | A1 | 11/2005 | Kim |
| 2007/0184193 | A1 | 8/2007 | Cha et al. |
| 2008/0136868 | A1 | 6/2008 | Lebens |
| 2008/0225083 | A1 | 9/2008 | McAvoy et al. |
| 2008/0284810 | A1 | 11/2008 | Shimizu et al. |
| 2009/0085972 | A1 | 4/2009 | Sim et al. |
| 2009/0186293 | A1 | 7/2009 | Fannin et al. |
| 2010/0315463 | A1 | 12/2010 | Escude et al. |
| 2013/0216738 | A1 | 8/2013 | Owusu et al. |
| 2016/0203973 | A1 | 7/2016 | Di et al. |
| 2017/0182778 | A1 | 6/2017 | Cattaneo et al. |

FOREIGN PATENT DOCUMENTS

| | | | |
|---|---|---|---|
| CN | 101557939 | A | 10/2009 |
| CN | 104245343 | A | 12/2014 |
| CN | 104253089 | A | 12/2014 |
| CN | 105711258 | A | 6/2016 |
| CN | 107953672 | A | 4/2018 |
| CN | 109910435 | A | 6/2019 |
| EP | 0568248 | A2 | 11/1993 |
| JP | 63-239063 | A | 10/1988 |
| JP | 08-252919 | A | 10/1996 |
| JP | 2000117977 | A | 4/2000 |
| JP | 2007058187 | A | 3/2007 |
| JP | 2011-161903 | A | 8/2011 |
| JP | 2018-199318 | A | 12/2018 |
| MX | 2017012076 | A | 2/2018 |
| TW | 200523126 | A | 7/2005 |
| TW | 201103758 | A | 2/2011 |
| WO | 97/35724 | A1 | 10/1997 |
| WO | WO-03041963 | A1 | 5/2003 |
| WO | WO-2014136440 | A1 | 9/2014 |
| WO | WO-2016157715 | A1 | 10/2016 |
| WO | 2017/050808 | A1 | 3/2017 |
| WO | 2019/110591 | A1 | 6/2019 |

* cited by examiner

UNIFORM PRINT HEAD SURFACE COATING

BACKGROUND

Print heads are utilized in a variety of applications, such as to print ink or other material on a surface. Print heads may include multiple nozzles via which ink or other material is dispensed for printing. Characteristics of the print head surface around the nozzles can affect performance of the print heads.

BRIEF DESCRIPTION OF FIGURES

Various examples may be more completely understood in consideration of the following detailed description in connection with the accompanying drawings, in which:

FIGS. 3A-3C show another apparatus and approach for coating a print head, in accordance with the present disclosure, in which FIG. 3A shows advancement of a transfer film, FIG. 3B shows vacuum adherence of the transfer film, and FIG. 3B shows application of the transfer film for selectively coating a surface.

Figure 1:
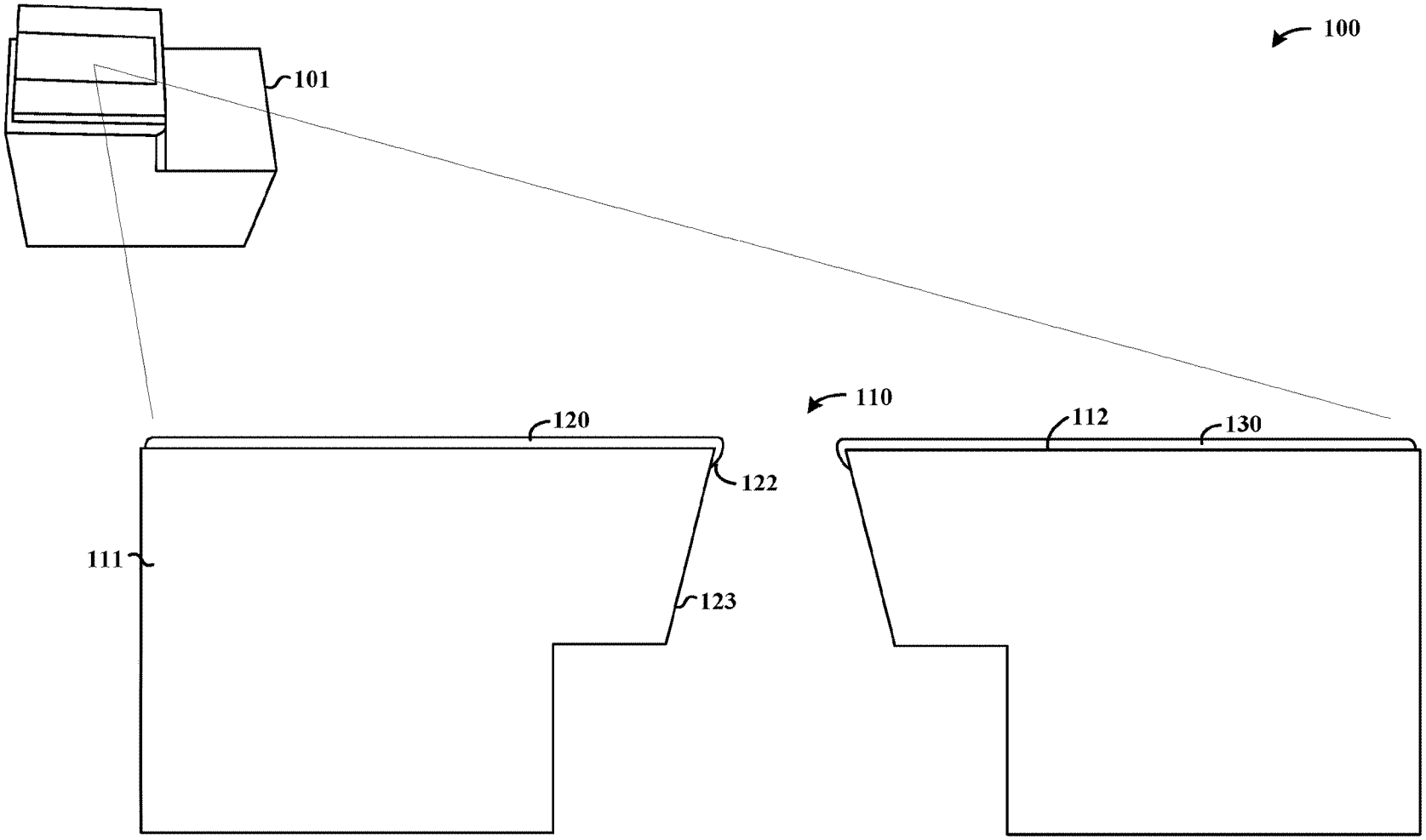
FIG. 1 shows a print head having a uniform coating, in accordance with the present disclosure.

While various examples discussed herein are amenable to modifications and alternative forms, aspects thereof have been shown by way of example in the drawings and will be described in detail. It should be understood, however, that the intention is not to limit the disclosure to the particular examples described. On the contrary, the intention is to cover all modifications, equivalents, and alternatives falling within the scope of the disclosure including aspects defined in the claims. In addition, the term "example" as used throughout this application is by way of illustration, and not limitation.

DETAILED DESCRIPTION

Aspects of the present disclosure are applicable to a variety of different systems and methods involving a coating on a print head surface. In certain non-limiting examples, aspects of the present disclosure may involve a print head coated with a material of a uniform thickness, in which the thickness may be set by transferring the material from a transfer film in which a portion of the material overlaps nozzle openings in the print head. In particular examples, the material is transferred from a web that is advanced for coating additional print heads. In some applications, such examples are advantageous in that the transfer film effects the transfer with a relatively low overlap into the nozzle openings, and in a manner that permits formation of a uniform coating with controlled thickness.

Certain specific examples involve a selective thin material layer transfer approach that facilitates controlling print head surface properties on a wafer or dry-pen level. A transfer film, such as a polymer film, with a thin layer of coating material is contacted to a print head surface to transfer half of a thickness of material from the polymer film to the print head. This can be implemented in a manner that is similar to a reverse stamping process. Certain examples involving a wafer level transfer process are carried out using a roller over a film such as polyethylene terephthalate (PET). Other examples involve polydimethylsiloxane (PDMS) stamps over film such as polyethylene (PE).

A variety of different types of materials can be coated on a print head, to suit various applications and otherwise control print head surface properties in a desirable manner. For instance, a low surface energy coating can be applied to reduce ink puddling and open up the ink space. A non-sticking coating can be applied to reduce print head servicing frequency, such as to mitigate crusting, and improve the printer up time. A hydrophilic coating can be used to reduce ink puddling as well. A lubricant coating can be used to reduce friction from interactions between the print head and a wiper/print media. Accordingly, a coating having properties or a combination of properties may address various issues such as puddling by using a low surface energy coating (wider ink space), frequent print head servicing by using a non-sticking/sacrificial coating, and print head damage by using a lubricating coating.

As may be consistent with the above, various examples involve wrapping a small amount of material at the nozzle exit of a print head. The amount of overlap may be roughly equal to the coating thickness. This overlap is pressed into the nozzle opening during the film transfer process.

For certain examples involving coating of dry pens, a uniform coating is present/formed around a firing chamber, such as over a silicon die, with incomplete coating over a top hat region above a corresponding ink slot as may be influenced via sagging in tenting.

In certain examples, the thickness of the material coating can be controlled using a spin coat process. This may be augmented by removing a thickness of the resulting film, such as by contacting the material coated on a second film to another film such that a thickness of the material adheres to the second film and is removed when the second film is removed.

For some examples, a portion of a print head surface is coated. This approach may be utilized to selectively adjust tackiness to minimize shipping tape damage. A stake head can be provided with surface topography that facilitates coating of a selected portion of the print head surface. For instance, a vacuum may be pulled onto a coated transfer film to conform the transfer film to the topography on the stake head.

In accordance with an example application or applications, a method may be carried out as follows. A layer of material is pressed onto a surface of a print head, in which the surface defines fluid nozzle openings. Portions of the layer of material are caused to adhere onto the surface and overlapping edges of the surface at the openings, with a uniform thickness on the surface. For instance, the uniform thickness resulting on the print head may be less than a total thickness of the layer pressed onto the surface. A remaining thickness of the material may be removed, such as upon removal of a transfer film. In some examples, portions of the layer are caused to be adhered onto the surface and overlapping edges of the surface at the openings by removing the layer over the openings, and adhering about half the thickness of the layer to the surface around the openings.

In various contexts, the layer of material may be pressed onto the surface by pressing a transfer film, which has the layer of material coated thereon, onto the surface. Portions of the layer may be caused to adhere onto the surface by removing the transfer film and another portion of the layer of material remaining adhered to the transfer film, leaving behind the portions of the layer at the uniform thickness adhered onto the surface. For instance, the material on the transfer film and over the fluid nozzle openings may remain adhered to the transfer film, while the material on the transfer film that is contacted with surface regions around the fluid openings is halved such that half the material remains adhered to the surface while the other half of the material is removed with the transfer film.

The thickness of material that is transferred to a print head may be set in a variety of manners. For example, a uniform thickness may be set by coating the layer of the material on the transfer film at a thickness that is twice the uniform thickness. Half of the thickness of the layer of material is caused to be adhered to the surface of the print head, via the application and subsequent removal of the transfer film.

Material may be overlapped over openings in a print head in a variety of manners. In some examples, the layer of material is pressed onto the surface in a manner that causes portions of the layer of material pressed onto the surface to seep laterally over the edges of the openings. In certain examples, an amount of the layer of material that overlaps edges of the openings is wrapped over the edges at an amount that corresponds to the uniform thickness.

As a further example, a uniform layer of material is coated onto a print head as follows. Using a layer of material from a transfer film, the material is pressed against a surface of the print head, in which the surface defines fluid nozzle openings in the surface that extend from the surface into the print head. Portions of the material pressed onto the surface are caused to adhere to the surface and to wrap over edges of the surface extending around the openings. The transfer film is then removed, and a thickness of the material pressed into contact with the surface remains adhered to the transfer film, therein forming a layer of the material on the surface with a uniform thickness. This approach may, for example, involve causing half of the thickness of the layer of material pressed into contact with the surface to adhere to the surface. Regions of the material that are over the openings may remain adhered to the transfer film (and thus removed upon removal thereof). In these contexts, forming the layer of the material on the surface may include coating the material onto the transfer film at a thickness that is double a desired uniform thickness on the print head, and pressing the material via the transfer film on the surface to transfer the desired uniform thickness of the material to the surface.

The amount of material overlapping edges of nozzle openings may be set in a variety of manners. In some examples, pressing the material against the surface as noted above includes causing portions of the material pressed onto the surface to seep laterally over the edges of the openings. This may, for example, involve applying sufficient pressure to the transfer film to move the portions of the material laterally relative to the surface. Causing the portions of the material to wrap over edges of the surface extending around the openings may include causing an amount of the layer of material of the uniform thickness to wrap over the edges.

Once the uniform coating has been applied, the print head may be processed in a variety of manners. In some examples, the layer of material formed to a uniform thickness on a print head is cured, after application and removal of a transfer film. This curing may involve, for example, application of ultraviolet light, heat or other manipulation that causes the curing.

In a more particular example, a continuous web having the layer of material on an extended portion of the web is utilized as a transfer film as characterized in examples herein. The material is transferred from the continuous web onto a print head in a manner as characterized herein, to form a layer of material with a uniform thickness on the print head. After this layer is formed, a second print head may be positioned in place of the print head having already had a coating applied. The continuous web of transfer film is advanced to align another portion of the layer of material over the second print head. After the continuous web of transfer film has been advanced, the portion of the layer of material from the transfer film that is aligned with the second print head is pressed against a surface of the second print head. The surface of the second print head also defines fluid nozzle openings in the surface that extend from the surface into the second print head. Portions of the material pressed onto the surface of the second print head are caused to adhere to the surface and to wrap over edges of the surface extending around the openings consistent with examples characterized herein. The transfer film is removed, and a thickness of the material pressed into contact with the surface that remains adhered to the transfer film to form a layer of the material on the surface with a uniform thickness.

As may be implemented with various examples, an apparatus includes a print head having a surface defining fluid nozzle openings. A layer of material is formed on the surface of the print head, having a uniform thickness and portions thereof overlapping edges of the surface at the openings. The portions of the layer of material overlapping the edges of the surface at the opening may extend over the edge at a distance of the uniform thickness. The print head may include an ink slot, in which a portion of the layer of material over the ink slot is incompletely coated. For instance, due to tenting or other characteristics, the region over the ink slot may exhibit such incomplete coating.

In a more particular example, the apparatus includes a transfer film having a portion of the layer of material, including a first portion having the uniform thickness in a pattern that matches the layer of material having the uniform thickness on the surface, and a second portion having a thickness that is greater than the uniform thickness in a pattern that matches the fluid nozzle openings. This transfer film may, for example, be part of an intermediate stage of manufacture in which the print head is provided with a uniform coating upon removal of the transfer film.

In some example applications, one or both of a print head and a transfer film are treated to facilitate the transfer of material to the print head. For instance, a plasma may be used to ash or otherwise modify a surface prior to coating.

Turning now to the Figures, FIG. 1 shows a print head 100 having a uniform coating on a surface thereof, in accordance with the present disclosure. The print head 100 includes a nozzle 110 defined by a bulk material 111 having a surface 112. The structure shown may be repeated to provide a multitude of such nozzles separated by bulk material 111, to suit particular applications. For instance, the nozzle 110 may be part of a larger print head shown at 101, and repeated in an upper surface thereof as depicted.

A uniform coating 120 is adhered to the surface 112 of the print head, and includes a portion 122 that overlaps into the opening of the nozzle 110. This portion may, for example, correspond to the thickness of the uniform coating 120. For example, the length of the overlap onto an inner sidewall 123 of the nozzle is about equal to the thickness of the uniform coating 120.

The thickness and placement of the uniform coating 120 can be set in a variety of manners, to suit particular applications. For example, the thickness may be set by a transfer process in which the material used to form the uniform coating is first applied to a transfer film at a greater thickness. The transfer film is then used to press the material onto the surface 112, causing a reduced thickness of the material to adhere to and remain on the surface when the transfer film is subsequently removed. The thickness of the material applied to the transfer film may, for example, be about twice that of a desired final thickness of the uniform coating 120, with the coating, transfer film and surface 112 operating to facilitate the transfer of about half of the material on the transfer film. Where characteristics of the transfer film, material and/or surface 112 affect the amount of material transferred such that it is different than half, the thickness of the material on the transfer film may be adjusted accordingly to achieve a desired final thickness on the print head surface.

In various example applications, the coating 120 is patterned by using a transfer film that is shaped or caused to conform to a shape, such that the coating 120 forms a pattern on the surface 112. For instance, such a pattern may be set so as to form the coating 120 extending a length at the region 130 identified by arrows, with the remaining region removed. Further, multiple such coatings may be applied with secondary coatings over the coating 120 as shown, and which secondary coating may be patterned at the position shown by region 130. These example approaches and resulting structures may, for example, be implemented in a manner consistent with FIG. 3.

Figure 2:
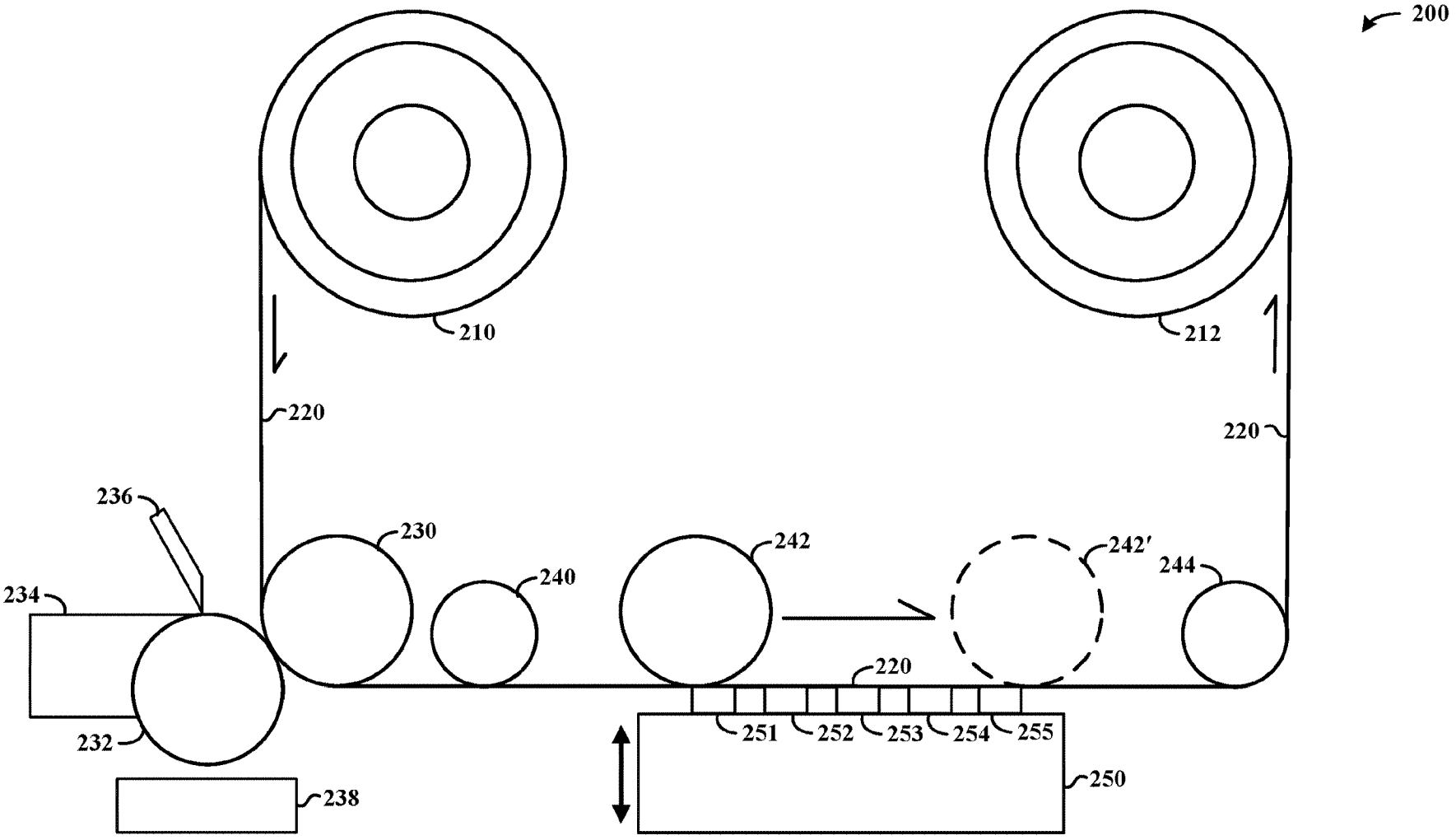
FIG. 2 shows an apparatus and approach for coating a print head, in accordance with the present disclosure.

FIG. 2 shows an apparatus 200 and approach for coating a print head, in accordance with the present disclosure. The apparatus 200 includes unwind roller 210 and rewind roller 212 that operate to advance a transfer film 220. The transfer film passes between a pressure roller 230 and a transfer roller 232 that operates to transfer material from a material chamber 234 to the transfer film 220. The roller 232 may, for example, be implemented with an anilox roller having surface characteristics that facilitate coating of the film 220 with a particular thickness of material from the material chamber 234. A doctor blade 236 may also facilitate application of a suitable material thickness to the transfer film 220, and a tray 238 may capture material from the roller 232.

The transfer film then passes by another roller 240 to another pressure roller 242. The pressure roller 242 may advance over a print head, moving to the position shown by 242'. The transfer film then passes by a further roller 244, and onto the rewind roller 212.

A variety of different types of componentry may be utilized in positioning print heads for transferring material from the transfer film 220. By way of example, a table 250, such as a vacuum table, is shown and may be used to hold a print head or several print heads. For illustration, print heads 251, 252, 253, 254 and 255 are shown held by table 250.

An example operational approach involving print heads 251-255 is as follows. The table 250 is lowered relative to the position shown in FIG. 2, in a direction shown by a double-sided arrow. The unwind roller 210 and rewind roller 212 operate to advance the film 220 between the transfer roller 232 and the pressure roller 230. The transfer roller 232 and pressure roller 230 apply a material coating to the transfer film 220, from the material chamber 234. The transfer film is advanced until a portion of the transfer film that is coated extends laterally past the location of print head 255, toward roller 244.

Once in position, the table 250 may operate to raise the print heads 251-255 and place them into contact with the transfer film 220. The pressure roller 242 is then advanced to the position shown at 242', rolling across the back side of the transfer film to press the transfer film onto surfaces of the print heads 251-255.

In other approaches, the table 250 is maintained in a fixed position such that upper surfaces of the print heads 251-255 are slightly below the transfer film 220. The pressure roller 242 may then be lowered to push the transfer film downward such that the coated material contacts the upper surface of the print heads as the pressure roller passes over them.

Figure 3B:
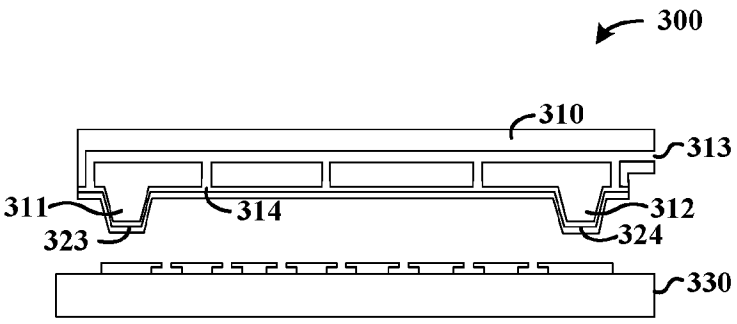
Figure 3A:
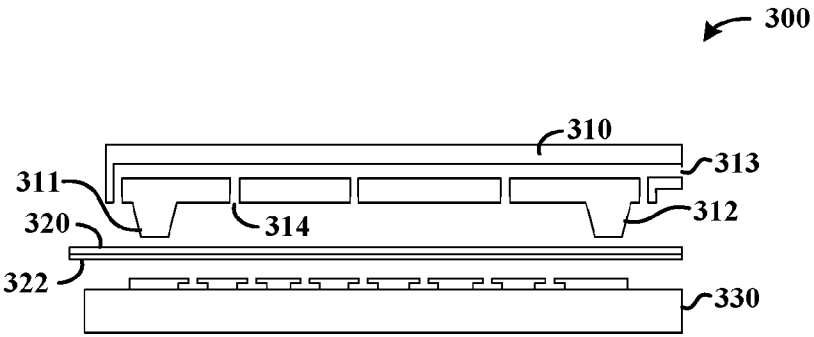
Figure 3C:
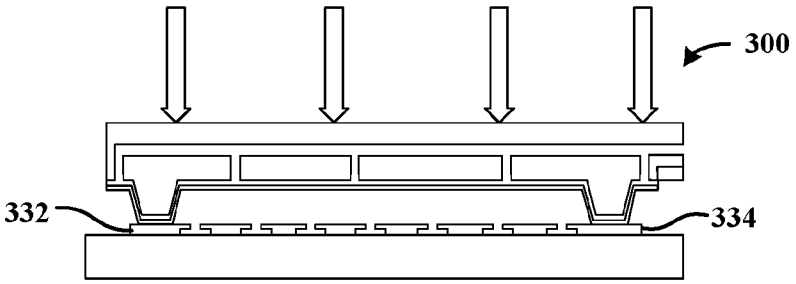

FIGS. 3A-3C show another apparatus 300 and approach for selectively coating portions of a print head, in accordance with the present disclosure. The apparatus includes a vacuum head 310 having protrusions 311 and 312, vacuum channel 313 with openings therein, including opening 314 labeled by way of example. Referring to FIG. 3A, a transfer film 320 having a material 322 coated thereon is advanced to the position as shown, extending laterally across the vacuum head 310 and above an underling part 330 such as a print head. This advancement may, for example, be carried out using the apparatus shown in FIG. 2.

Referring to FIG. 3B, the transfer film 320 has been drawn by a vacuum to confirm to the underlying surface of the vacuum head 310, and over the protrusions 311 and 312. This results in the transfer film and material at regions 323 and 324 protruding below the rest of the film. Once the transfer film with the material thereon are adhered to the shape of the vacuum head 310, the vacuum head is lowered while maintaining the vacuum as shown in FIG. 3C so that the portions of the transfer film 323 and 324 at the protrusions 311 and 312 are contacted with the underlying part 330, at regions 332 and 334. This transfers a portion of the material 322 at 323 and 324 onto the underling part 330 at a uniform thickness. This may, for example, include coating a region around a nozzle opening, such as shown in FIG. 1. After transfer, the vacuum head 310 may be raised, the vacuum released and the transfer film 320 advanced past the vacuum head for a subsequent application.

Figure 4:
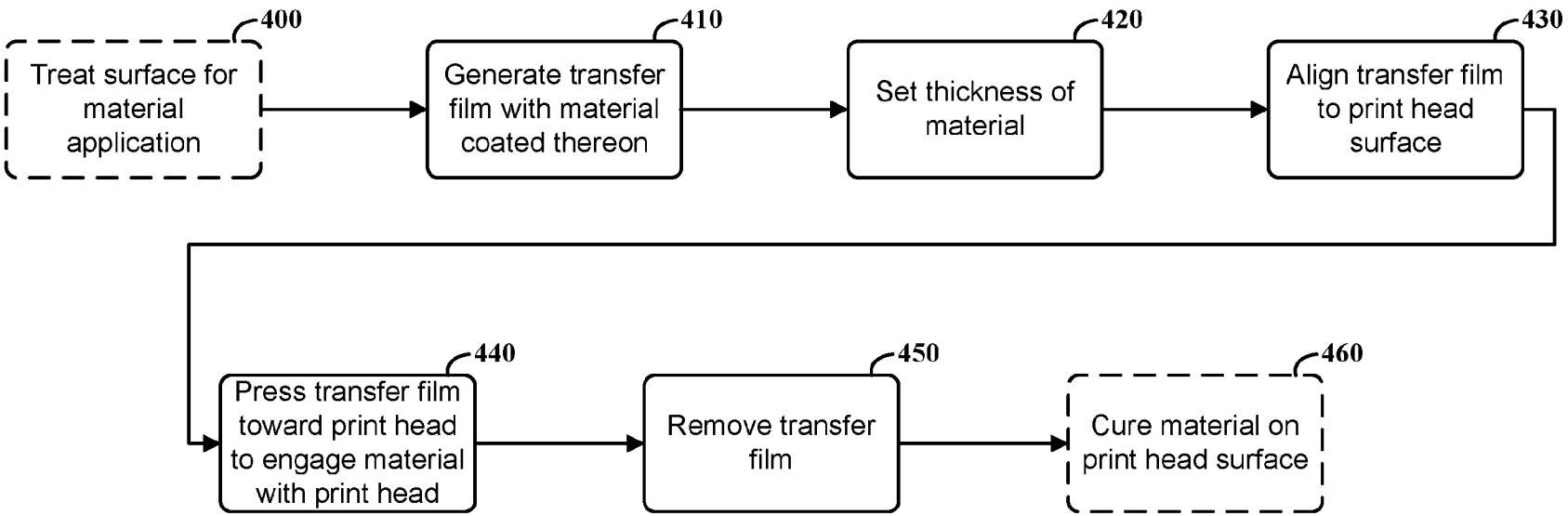
FIG. 4 shows a data flow diagram for a method of coating a print head, in accordance with the present disclosure.

FIG. 4 shows a data flow diagram for a method of coating a print head, in accordance with the present disclosure. At block 400, an operation is shown for treating a surface of one or both of a print head and transfer film to be used to apply a material to the print head. At block 410, a transfer film is generated with a material coated thereupon, and a thickness of the material is set at block 420. In some examples, the thickness set at block 420 is carried out with at block 410, such as by applying the coating as shown in FIG. 2. In other examples, the thickness is set at block 420 by using respective transfer processes to remove portions of the material until a desired material thickness is set.

At block 430, the transfer film is aligned to a print head surface. This may include, for example, aligning the print head with a stamp type head, or aligning a continuous web of material with a print head. At block 440, the material coated onto the transfer film is engaged with the print head by pressing the transfer material toward the print head. This may be carried out, for example, by rolling a pressure roller across the print head, or by causing one or both of the print head and transfer film to move relative to one another. At block 450, the transfer film is removed from the print head, leaving a uniform thickness of the material coated thereon and overlapping openings in the print head in a manner as characterized herein. An optional curing operation may be carried out at block 460, to cause the material on the print head to cure. Further, some or all of blocks 410-460 may be repeated for coating a subsequent layer of material on the print head.

Terms to exemplify orientation, such as in referring to an upper surface of a print head, may be used herein to refer to relative positions of elements as shown in the figures. It should be understood that the terminology is used for notational convenience and that in actual use the disclosed structures may be oriented in a manner that is different from the orientation shown in the figures. For instance, a lower surface of a print head may be coated via a transfer process as characterized herein, with a transfer film below the print head and with nozzles of the print head being directed downward. Thus, the terms should not be construed in a limiting manner.

Based upon the above discussion and illustrations, various modifications and changes may be made to the various examples without strictly following those illustrated and described herein. For example, methods as exemplified in the Figures may involve actions carried out in various orders, with aspects herein retained, or may involve fewer or more actions. Various noted examples may be combined, such as by combining aspects of the processes shown in FIG. 2 and or FIGS. 3A-3C with the resulting print head of FIG. 1. Materials may also be combined, such as those noted above to achieve various surface properties. Additional transfer operations may be implemented to set material thickness, prior to coating. Furthermore, additional coating operations may be carried out, such as to provide a multi-layer coating in which each coating may be cured prior to application of a subsequent coating. Such modifications do not depart from the true spirit and scope of various aspects of the disclosure, including aspects set forth in the claims.

What is claimed is:

1. A method comprising:

pressing a layer of material onto a surface of a print head, the surface defining fluid nozzle openings; and causing adherence of portions of the layer of material onto the surface and overlapping edges of the surface at the openings and with a uniform thickness on the surface by removing the layer over the openings and adhering about half the thickness of the layer to the surface around the openings.

2. The method of claim 1, wherein pressing the layer of material onto the surface includes pressing a transfer film, which has the layer of material coated thereon, onto the surface; and causing adherence of the portions of the layer onto the surface includes removing the transfer film and another portion of the layer of material remaining adhered to the transfer film, leaving behind the portions of the layer at the uniform thickness adhered onto the surface.

3. The method of claim 2, further including setting the uniform thickness by coating the layer of the material on the transfer film at a thickness that is twice the uniform thickness, and causing the adherence by adhering half of the thickness of the layer of material to the surface of the print head.

4. The method of claim 1, wherein the uniform thickness is less than a total thickness of the layer pressed onto the surface.

5. The method of claim 1, wherein causing the adherence of the portions of the layer of material overlapping the edges of the surface includes causing an amount of the layer of material of the uniform thickness to wrap over the edges.

6. A method comprising:

using a layer of material from a transfer film, pressing the material against a surface of a print head, the surface defining fluid nozzle openings in the surface that extend from the surface into the print head, and causing portions of the material pressed onto the surface to adhere to the surface and to wrap over edges of the surface extending around the openings; and removing the transfer film and a thickness of the material pressed into contact with the surface that remains adhered to the transfer film, and forming a layer of the material on the surface with a uniform thickness.

7. The method of claim 6, wherein pressing the material against the surface includes causing half of the thickness of the layer of material pressed into contact with the surface to adhere to the surface, and maintaining regions of the material over the openings adhered to the transfer film.

8. The method of claim 7, wherein forming the layer of the material on the surface includes coating the material onto the transfer film at a thickness that is double the uniform thickness, and pressing the material via the transfer film on the surface, therein transferring the uniform thickness of the material to the surface.

9. The method of claim 6, wherein pressing the material against the surface of the print head includes positioning the transfer film with a pattern and pressing the material in the form of the pattern against the surface, and wherein forming the layer of the material includes forming the layer of material in the form of the pattern.

10. The method of claim 6, wherein the transfer film is a continuous web having the layer of material on an extended portion of the web, further including, after forming the layer of material with the uniform thickness, positioning a second print head in place of the print head;

advancing the continuous web to align another portion of the layer of material over the second print head;

after advancing the continuous web of transfer film, using the other portion of the layer of material from the transfer film that is aligned with the second print head, pressing the material against a surface of the second print head, the surface defining fluid nozzle openings in the surface that extend from the surface into the second print head, and causing portions of the material pressed onto the surface to adhere to the surface and to wrap over edges of the surface extending around the openings; and removing the transfer film and a thickness of the material pressed into contact with the surface that remains adhered to the transfer film, and forming a layer of the material on the surface with a uniform thickness.

11. An apparatus comprising:

a print head having a surface defining fluid nozzle openings;

a layer of material on the surface of the print head, the layer of material having a uniform thickness on the surface and portions thereof overlapping edges of the surface at the openings; and a transfer film having a portion of the layer of material, including a first portion having the uniform thickness in a pattern that matches the layer of material having the uniform thickness on the surface, and a second portion having a thickness that is greater than the uniform thickness in a pattern that matches the fluid nozzle openings.

12. The apparatus of claim 11, wherein the portions of the layer of material overlapping the edges of the surface at the opening extend over the edges at a distance of the uniform thickness.

13. The apparatus of claim 11, wherein the print head includes an ink slot, and a portion of the layer of material over the ink slot is incompletely coated.

* * * * *